US010435963B2

(12) United States Patent
Vepuri

(10) Patent No.: US 10,435,963 B2
(45) Date of Patent: Oct. 8, 2019

(54) PASSIVE INLINE MOTION COMPENSATOR

(71) Applicant: Aquamarine Subsea Houston, Inc., Pearland, TX (US)

(72) Inventor: Hareesh Vepuri, Pearland, TX (US)

(73) Assignee: AQUAMARINE SUBSEA HOUSTON, INC., Pearland, TX (US)

( * ) Notice: Subject to any disclaimer, the term of this patent is extended or adjusted under 35 U.S.C. 154(b) by 0 days.

(21) Appl. No.: 15/617,974

(22) Filed: Jun. 8, 2017

(65) Prior Publication Data

US 2018/0355681 A1 Dec. 13, 2018

(51) Int. Cl.

*E21B 19/00* (2006.01)
*E21B 41/00* (2006.01)
*B63B 35/44* (2006.01)

(52) U.S. Cl.

CPC ..... *E21B 19/006* (2013.01); *E21B 41/0007* (2013.01); *B63B 2035/448* (2013.01)

(58) Field of Classification Search

CPC ... E21B 19/006; E21B 41/0007; B63B 35/44; B63B 2035/448

See application file for complete search history.

(56) References Cited

U.S. PATENT DOCUMENTS 3,714,995 A * 2/1973 Hanes ..... E21B 19/09 175/27
3,721,293 A * 3/1973 Ahlstone ..... E21B 19/09 166/355
3,912,227 A * 10/1975 Meeker ..... E21B 19/09 175/5
4,026,583 A * 5/1977 Gottlieb ..... B23K 20/085 228/107
4,365,787 A * 12/1982 Latimer ..... B63B 35/44 254/106
4,379,657 A * 4/1983 Widiner ..... E21B 19/006 405/168.4
4,432,420 A * 2/1984 Gregory ..... E21B 19/09 166/355
4,501,219 A * 2/1985 Bates, Jr. ..... E21B 19/006 114/264
4,928,616 A * 5/1990 Robishaw ..... B60P 7/13 114/267
5,735,371 A * 4/1998 Jobelius ..... F16F 9/0218 188/276
7,231,981 B2 * 6/2007 Moe ..... E21B 19/09 166/355
7,934,561 B2 * 5/2011 Ormond ..... E21B 19/006 114/264

(Continued)

*Primary Examiner* — Matthew R Buck
*Assistant Examiner* — Aaron L Lembo

(57) ABSTRACT

A system and method directed to passively compensating for the vertical movement of an offshore platform due to fluctuations of the sea level. The system, which is deployed from the offshore platform, includes an inline motion compensator, a top drive assembly and a static lift frame that are coupled together. In an embodiment, the inline motion compensator comprises an elongated vessel containing a piston which defines a blind chamber and a compensation chamber of the elongated vessel. The compensation chamber is filled with pressurized gas, which along with an elongated rod disposed therein, is used to compensate for the relative movement between the offshore platform and a hydrocarbon well assembly that it is coupled to system.

20 Claims, 7 Drawing Sheets

(56) References Cited

U.S. PATENT DOCUMENTS

| | | | | |
|---|---|---|---|---|
| 8,162,062 | B1 | 4/2012 | Barone et al. | |
| 8,251,148 | B2 * | 8/2012 | von der Ohe | B63B 39/00 166/355 |
| 8,347,982 | B2 * | 1/2013 | Hannegan | E21B 19/09 166/347 |
| 8,561,722 | B2 * | 10/2013 | Parlin | E21B 4/18 166/255.3 |
| 8,590,626 | B2 | 11/2013 | Barone et al. | |
| 9,260,927 | B2 * | 2/2016 | Hannegan | E21B 19/09 |
| 9,359,837 | B2 * | 6/2016 | Poehner | E21B 19/002 |
| 9,410,381 | B2 * | 8/2016 | Plain | E21B 19/006 |
| 9,440,829 | B2 * | 9/2016 | Sadiq | B66F 11/00 |
| 9,476,264 | B2 * | 10/2016 | Plain | E21B 19/006 |
| 9,718,652 | B2 * | 8/2017 | Cannell | B66C 23/53 |
| 2014/0202327 | A1 * | 7/2014 | Ellis | E21B 19/006 92/143 |
| 2014/0331908 | A1 * | 11/2014 | Plain | E21B 41/0007 114/122 |
| 2015/0362039 | A1 * | 12/2015 | Cannell | E21B 19/002 188/267.2 |
| 2016/0060976 | A1 * | 3/2016 | Plain | E21B 19/006 166/355 |

* cited by examiner

PASSIVE INLINE MOTION COMPENSATOR

FIELD OF THE DISCLOSURE

The present disclosure relates generally to the drilling operations from an offshore platform. More specifically, the present disclosure relates to systems and methods for the compensation of vertical movement of an offshore platform due to fluctuations of the surface level of a body of water during the drilling of a hydrocarbon well.

BACKGROUND

Motion compensation systems are used in the offshore drilling industry to mitigate the undesired effects between floating offshore platforms and assemblies which may be fixed to a floor of a body of water. These undesired effects include changes in forces and stresses on the assemblies and the hysteresis, i.e. the rapid start and stop of vertical movement of the offshore platforms. Currents, wind and other weather phenomena all impact the elevation of the surface of the body of water thereby creating vertical movement between the offshore platforms and the assemblies.

Many motion compensation systems use a cylinder and a gas/liquid accumulator apparatus to dampen the movement between the offshore platform and an assembly which may be fixed to the seabed. In these systems, the cylinder houses a piston with a rod extending from one side of the piston. Pressurized liquid is used on both the rod side of the piston and the opposing side to counterbalance the vertical movement of the offshore platform. A gas/liquid accumulator is used to introduce pressurized liquid to the rod side of the piston. The gas/liquid accumulator typically consists of a vessel with two chambers separated by an elastic diaphragm, a totally enclosed bladder or a floating piston. One chamber contains hydraulic liquid and is connected to a hydraulic line that is in fluid communication with the rod side of the piston. The other chamber contains a pressurized gas. As the pressure of the gas further increases within the gas/liquid accumulator, the hydraulic liquid is forced out of its chamber and into the cylinder on at least the rod side of the piston.

The use of gas/liquid accumulator apparatuses in motion compensation systems is undesirable because such an accumulator adds additional cost and complexity to the operation of the motion compensation system. Depending on the magnitude of the load to be compensated, multiple gas/liquid accumulators may be required to effectively operate the system. This is due in part to the load variance of pressurized liquid. Pressurized gas at the same pressure and volume as that of the pressurized liquid is able to compensate a higher load. Therefore a need has arisen for a motion compensation system that can effectively operate using pressurized gas in lieu of pressurized liquid on the rod side of the cylinder thereby eliminating the use of gas/liquid accumulator systems.

DESCRIPTION OF ILLUSTRATIVE EMBODIMENTS

Figure 1:
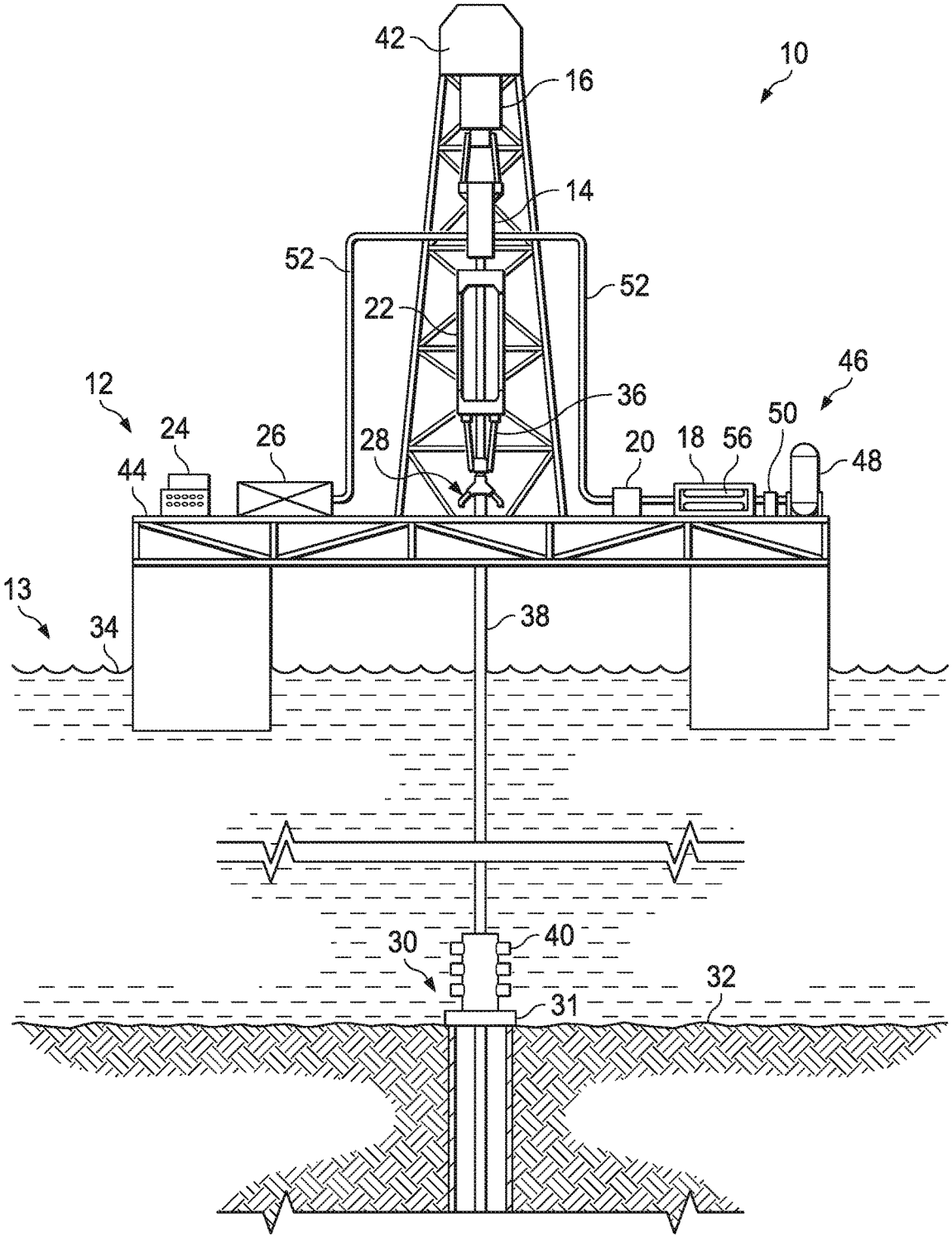
FIG. 1 depicts a passive motion compensation system used in a well intervention operation deployed on a floating offshore platform, according to one or more illustrative embodiments.

Embodiments of the present disclosure relate to a passive compensation system for dampening the relative motion caused by a fluctuating body of water between an offshore platform and a well intervention assembly deployed subsea in association with a subsea well. While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described. Thus, the operational behavior of embodiments will be described with the understanding that modifications and variations of the embodiments are possible, given the level of detail presented herein.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

As noted above, embodiments of the present disclosure relate to a passive compensation system for dampening the relative motion caused by a fluctuating body of water between an offshore platform and a well intervention assembly deployed subsea in association with a subsea well. Without limiting the foregoing, a "well intervention assembly" generally refers to any structure extending down from the surface to a wellhead, including but not limited to drill pipe, risers, production pipe and the like. The term "compensation" and its variants are used herein to describe the act of counterbalancing forces created by the vertical motion of an offshore platform in response to the motion of the body of water. In a generalized embodiment, a passive compensation system includes an inline motion compensator, a gas pressure vessel assembly, a charging manifold, and a static lift frame. Such a system may be used to compensate for the vertical movement of an offshore platform due to fluctuations of the surface level of a body of water in a subsea hydrocarbon well operation while minimizing the overall size and complexity of the system compared to prior art systems. In one embodiment, the passive compensation system of the disclosure may include a controller which is in pneumatic fluid communication with the gas pressure vessel assembly, the inline motion compensator and the charging manifold. In yet another embodiment, the controller may be in hydraulic fluid communication with the inline motion compensator. In an additional embodiment, the system may include a gas compression system for producing and regulating pressurized gas for the inline motion compensator.

Referring to FIG. 1, a passive motion compensation system 10 deployed on an offshore platform 12 is illustrated. Platform 12 is shown for illustrative purposes only, and persons of ordinary skill in the art will understand that platform 12 may be any fixed or floating platform, ship, vessel submersible, semi-submersible or other structure from which offshore hydrocarbon drilling and/or production activities may be conducted. The passive motion compensation system 10 is intended for use on any offshore drilling vessel that is primarily either moored or dynamically positioned and therefore subject to the motions created by a body of water 13, such as a sea, supporting the platform 12. In one or more embodiments, the passive motion compensation system 10 may include an inline motion compensator 14 supported from above by a top drive assembly 16. A gas pressure vessel assembly 18 is in fluid communication with a charging manifold 20 from which gas is provided to the inline motion compensator 14. A static lift frame 22 is supported below the inline motion compensator 14. A controller 24 may be deployed to regulate operation of the inline motion compensator 14 and/or the static lift frame 22. In another embodiment, the passive motion compensation system 10 may additionally include a silencer 26 to mitigate the sound of the gas being expelled from the inline motion compensator 14. The static lift frame 22 in turn supports well intervention equipment 28. As described in more detail below, the passive motion compensation system 10, through the inline motion compensator 14, functions to mitigate the undesired effects caused by waves 34 or the general motion of the body of water 13 of relative movement between the offshore platform 12 and the well intervention equipment 28 deployed subsea in association with a subsea well 30. In this regard, the well intervention equipment 28 may be physically attached to a wellhead 31 deployed at the top of well 30, or may simply be deployed adjacent the floor 32 of the body of water 13 or may pass through wellhead 31 into well 30 that is affixed to the floor 32 of the body of water 13. In certain embodiments, bails 36 may be used to couple the static lift frame 22 with the well intervention equipment 28. In one or more embodiments, the inline motion compensator 14 is a passive apparatus that need not be equipped with electrical equipment, but can simply function using pneumatic and hydraulic systems, which may be, in some embodiments, at least partially automatically responsive to the motion of the body of water 13.

The well intervention equipment 28 may include a well intervention riser 38, which is supported via the static lift frame 22 and extending down to wellhead 31. Wellhead 31 may include a blowout preventer ("BOP") 40. Although well intervention equipment 28 is depicted in FIG. 1 generally in association with well production operations, the passive motion compensation system 10 may be used to compensate equipment in other well operations, such as, well drilling, well completion or coiled tubing applications. Further, the well intervention equipment 28 may include equipment employed in stimulating production zones, acquiring downhole integrity, formation and flow data, repairing or replacing broken equipment and removing debris and deposits as known in the art.

A derrick 42 is shown on the deck 44 of the offshore platform 12. The derrick 42 may be used to support the inline motion compensator 14 via the top drive assembly 16. The top drive assembly 16 may be used to adjust the height of the inline motion compensator 14 and/or the static lift frame 22 relative to the elevation of the deck 44 of the offshore platform 12. Also preferably located on the deck 44 of the offshore platform 12 are the gas pressure vessel assembly 18, charging manifold 20 and controller 24 of the passive motion compensation system 10. In some embodiments, the offshore platform 12 includes a gas source 46, such as gas storage vessel or a gas compression system, which gas compression system may include a gas compressor 48 and a pressure regulator 50.

Figure 2:
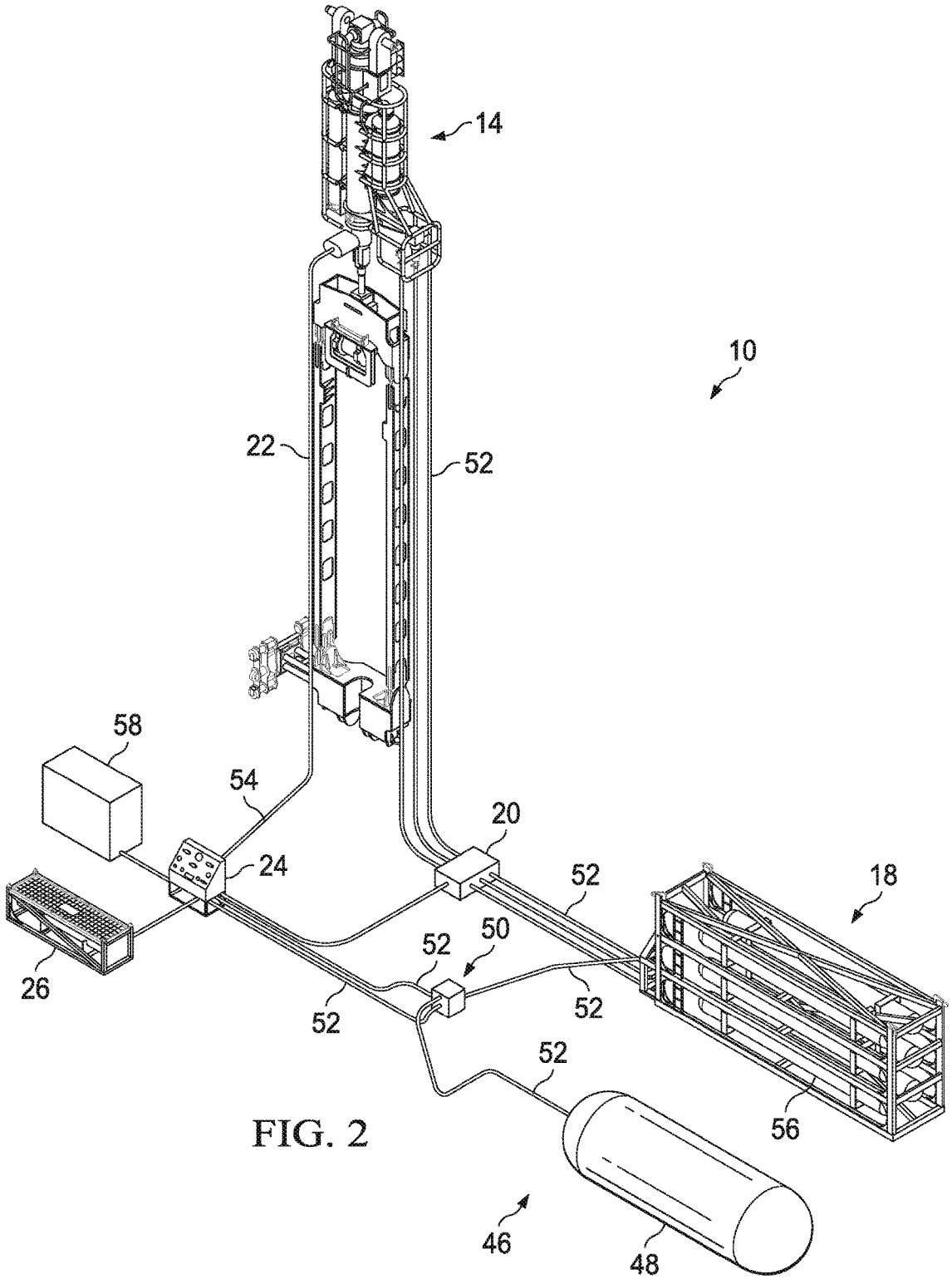
FIG. 2 depicts a schematic representation of the passive motion compensation system, according to one or more illustrative embodiments.

FIG. 2 depicts a schematic representation of the passive motion compensation system 10 which illustrates pneumatic conduits 52 and hydraulic conduits 54 that convey pressurized fluid to various components within the passive motion compensation system 10. The pneumatic conduits 52 are used to convey pressurized gas to the inline motion compensator 14. As discussed further herein, the hydraulic conduits 54 are used to facilitate unlocking the inline motion compensator 14. The gas compression system 46, which, as described above, in some embodiments includes a gas compressor 48 and a pressure regulator 50, supplies compressed gas to one or more vessels 56 of the gas pressure vessel assembly 18. In an exemplary embodiment the compressed gas is air. In an alternative embodiment, the compressed gas may be an inert gas such as nitrogen.

In one or more embodiments, the pressure of the gas supplied to the gas pressure vessel assembly 18 is calculated based on the combined load of the static lift frame 22 and the well intervention equipment 28, with consideration given to buoyant forces from the body of water 13. This calculated pressure may be defined as the gas compensation pressure value for the passive motion compensation system 10. Once the gas compensation pressure value is determined, the controller 24 may be used to activate the gas compressor 48.

Pressurized gas is then conveyed from the gas compressor 48 by a pneumatic conduit 52 through the pressure regulator 50, which may be set to a desired gas compensation pressure value, to pressurize the vessels 56 of the gas pressure vessel assembly 18. Gas conveyed through the pressure regulator 50 also may be routed to the controller 24 and on to the charging manifold 20 to pressurize a plurality of pneumatic conduits 52 in fluid communication between the gas pressure vessel assembly 18, charging manifold 20 and the inline motion compensator 14 to the gas compensation pressure value. In any event, pressurized gas is supplied to the inline motion compensator 14 to counteract motion in both axial directions. The pressurized gas conveyed in the pneumatic conduits 52 provides a compensating force to the inline motion compensator 14 to counterbalance the load of the static lift frame 22 and the well intervention equipment 28 against the vertical movement of offshore platform 12 due to the motion of the body of water 13. Using pressurized gas, as described in more detail below, for compensation provides a load variance advantage over the prior art's use of pressurized liquid. For example, in most instances, a volume of gas of pressurized to a certain value is able to compensate or carry a load greater than that of the same volume of liquid pressurized to the same value.

Once the inline motion compensator 14 is pressurized to the desired compensation gas pressure value, the controller 24 also may be used to convey pressurized hydraulic fluid from a hydraulic power unit 58 through a hydraulic conduit 54 to unlock the inline motion compensator 14 and begin compensation. In the event the load from the well intervention equipment 28 is increased, the gas compensation pressure value will be recalculated and the controller 24, the gas compression system 46 and the charging manifold 20 may be used to increase the pressure of the gas in the plurality of pneumatic conduits 52, vessels 56 and the inline motion compensator 14.

Figure 3:
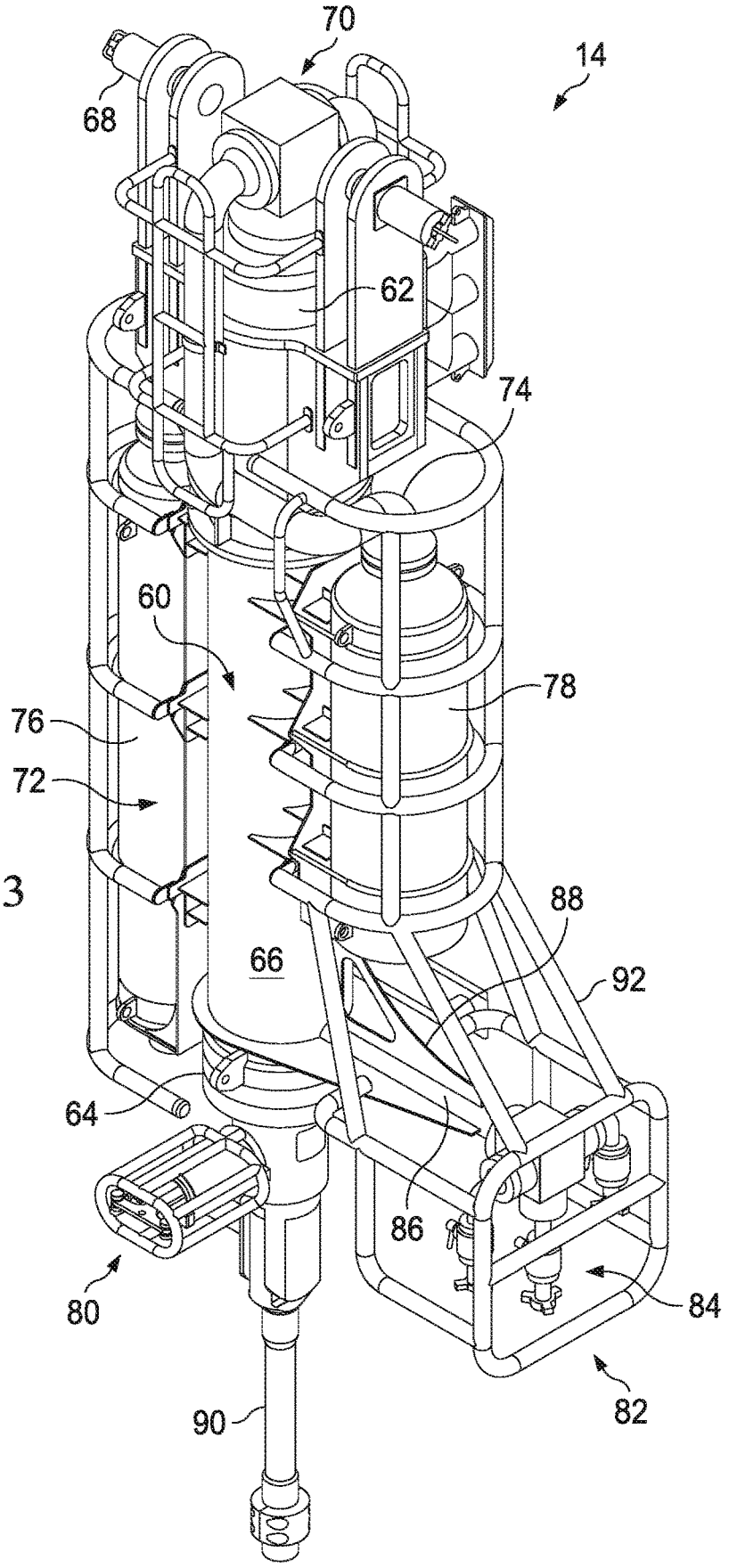
FIG. 3 depicts a perspective view of a passive inline motion compensator of the passive motion compensation system, according to one or more illustrative embodiments.

Turning now to FIG. 3, a perspective view of the inline motion compensator 14 is presented. The inline motion compensator 14 may be configured in either a locked or an unlocked state. In a locked state, the inline motion compensator 14 supports the static load of the static lift frame 22 and the well intervention equipment 28. When unlocked, the inline motion compensator 14 is free to reciprocate to compensate for the motion of the body of water 13, i.e., currents and waves 34, and the relative movement between the offshore platform 12 and both the static lift frame 22 and well intervention equipment 28. In certain embodiments, the inline motion compensator 14 includes an elongated vessel assembly 60 having a first end 62, a second end 64 and an elongated vessel 66. In certain embodiments, the elongated vessel 66 is a cylinder. The first end 62 of the elongated vessel assembly 60 includes a bail assembly 68 for attachment with the top drive assembly 16. The first end 62 of the elongated vessel assembly 60 may also include a speed control valve 70 for regulating the conveyance of liquid between the elongated vessel 66 and a reservoir assembly 72 of the inline motion compensator 14 through a plurality of gas/liquid conduits 74. In an exemplary embodiment, the reservoir assembly 72 includes a first pressurized gas/liquid vessel 76 and a second pressurized gas/liquid vessel 78. However, it is anticipated the inline motion compensator 14 may function with at least one vessel in the reservoir assembly 72. As discussed in more detail below, the reservoir assembly 72 functions to store liquid displaced from the elongated vessel 66 while the inline motion compensator 14 is unlocked and in compensation mode.

The second end 64 of the elongated vessel assembly 60 may include a lock assembly 80 that is operable to secure the inline motion compensator 14 from compensating operation. A compensation manifold assembly 82 is also illustrated and facilitates pneumatic fluid communication between the inline motion compensator 14 and the plurality of pneumatic conduits 52 as previously discussed with respect to FIG. 2. In some embodiments, the compensation manifold assembly 82 includes a plurality of isolation valves 84, an inlet 86 and a stabilizer 88. The inlet 86 provides a conduit for the pressurized gas to enter the elongated vessel 66 and the stabilizer 88 prevents movement of the inlet 86 due to the force of the pressurized gas entering therein.

Coupled to the second end 64 of the elongated vessel assembly 60 is a lift sub assembly 90. The lift sub assembly 90 provides a fixed connection between the inline motion compensator 14 and the static lift frame 22 (see FIG. 2). The inline motion compensator 14 may also have a protective bumper frame 92 that includes a series of weldments or, in an alternative embodiment, jointed members strategically positioned around the first end 62, second end 64, the reservoir assembly 72 and the lock assembly 80.

Figure 4A:
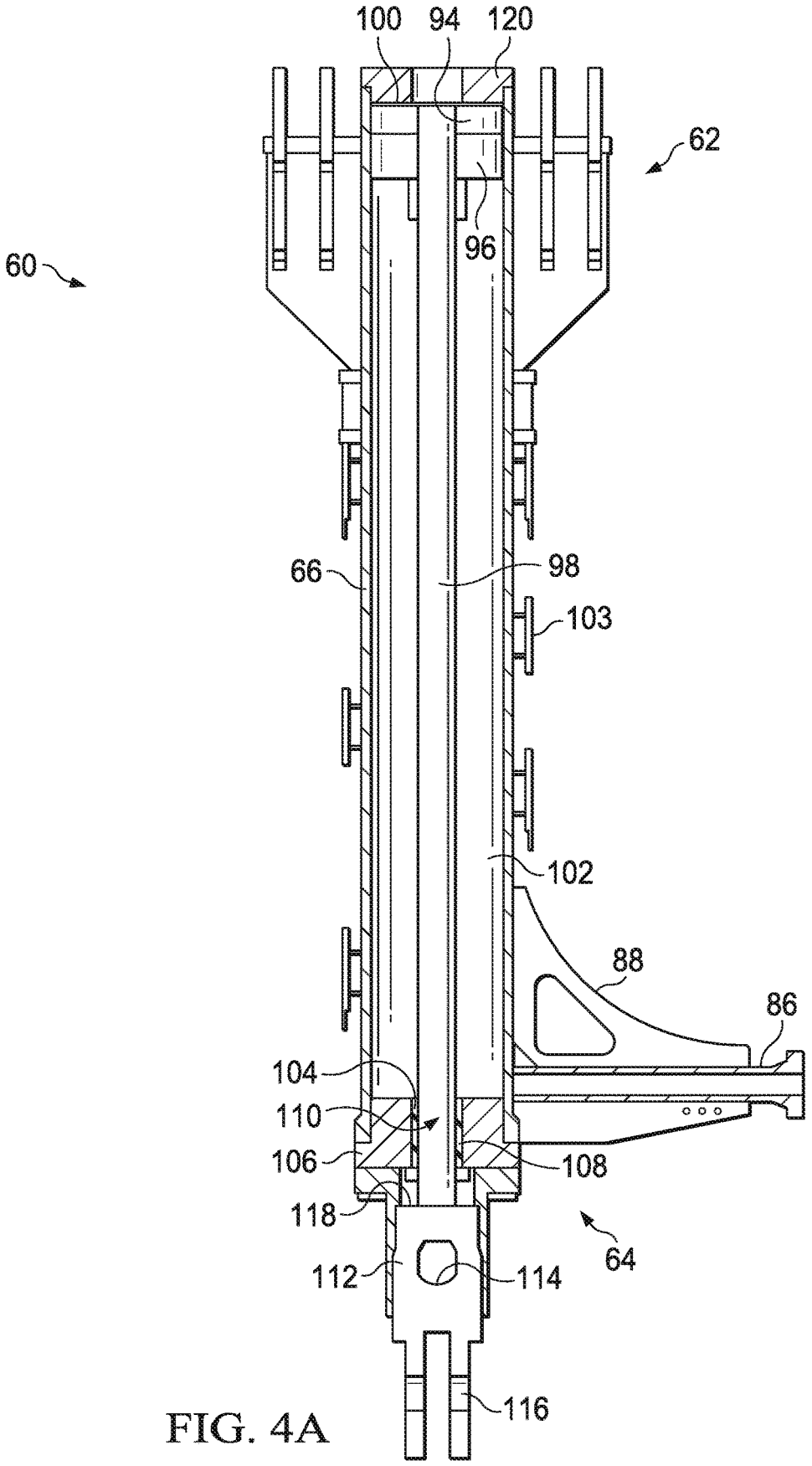
FIG. 4A depicts an exemplary cross-sectional view of an elongated vessel assembly of the passive inline motion compensator, according to one or more illustrative embodiments.

FIG. 4A, depicts a cross-sectional view of the elongated vessel assembly 60 when the inline motion compensator 14 is in a locked, non-compensation configuration. The elongated vessel 66 of the elongated vessel assembly 60 contains a piston 94 slidingly disposed therein. Piston 94 has a piston head 96 and an elongated rod 98. The piston 94 defines a blind (or liquid) chamber 100 and a compensation (or pressurized gas) chamber 102 within the elongated vessel 66, with the elongated rod 98 of the piston 94 disposed in the compensation chamber 102 and the blind chamber 100 situated on the opposite side of the piston head 96. When the inline motion compensator 14 is in compensation configuration, the respective volumes of the blind chamber 100 and compensation chamber 102 are dynamic. Further, when the inline motion compensator 14 is in compensation configuration, the blind chamber 100 is filled with liquid, which in some embodiments may be oil or a similar hydraulic fluid, and the compensation chamber 102 is filled with pressurized gas. In certain embodiments, a plurality of supports 103 may be radially spaced about the elongated vessel 66 to support the first pressurized gas/liquid vessel 76 and second pressurized gas/liquid vessel 78 of the reservoir assembly 72.

The elongated rod 98 extends from the elongated vessel assembly 60 via an opening 104 formed in an elongated rod ring 106 located at the second end 64 of the elongated vessel assembly 60. Rod seals 108 made of polytetrafluoroethylene (PTFE) are provided between the elongated rod 98 and the elongated rod ring 106 to prevent pressurized gas from escaping the compensation chamber 102 of the elongated vessel 66. In other embodiments, rod seals 108 may be fabricated from other thermoplastic polymers.

The distal end 110 of the elongated rod 98 contains a rod head 112 which includes an engagement mechanism 114, which in some embodiments, may take the form of a first aperture 114. The engagement mechanism 114, in conjunction with the lock assembly 80, is utilized to inhibit movement of the elongated rod 98 thereby locking the inline motion compensator 14. The lock assembly 80 may be movable between a first position in which the lock assembly 80 engages the engagement mechanism 114 and a second position in which the lock assembly 80 is disengaged from the rod head 112. In some embodiments, the rod head 112 contains a first aperture 114 and a second aperture 116, oriented on an axis transverse from that of the first aperture 114, which may be used to facilitate connecting the lift sub assembly 90 with the elongated vessel assembly 60. Upward travel of the elongated rod 98 within the elongated vessel assembly 60 may be, in part, limited by a shoulder 118 located in the second end 64 of the elongated vessel assembly 60.

As shown in FIG. 4A, when the inline motion compensator 14 is in a locked state, the piston head 96 is substantially retracted within the elongated vessel 66 and the volume of blind chamber 100 is minimized. In such a position, rod head 112 may likewise be adjacent shoulder 118.

Figure 4B:
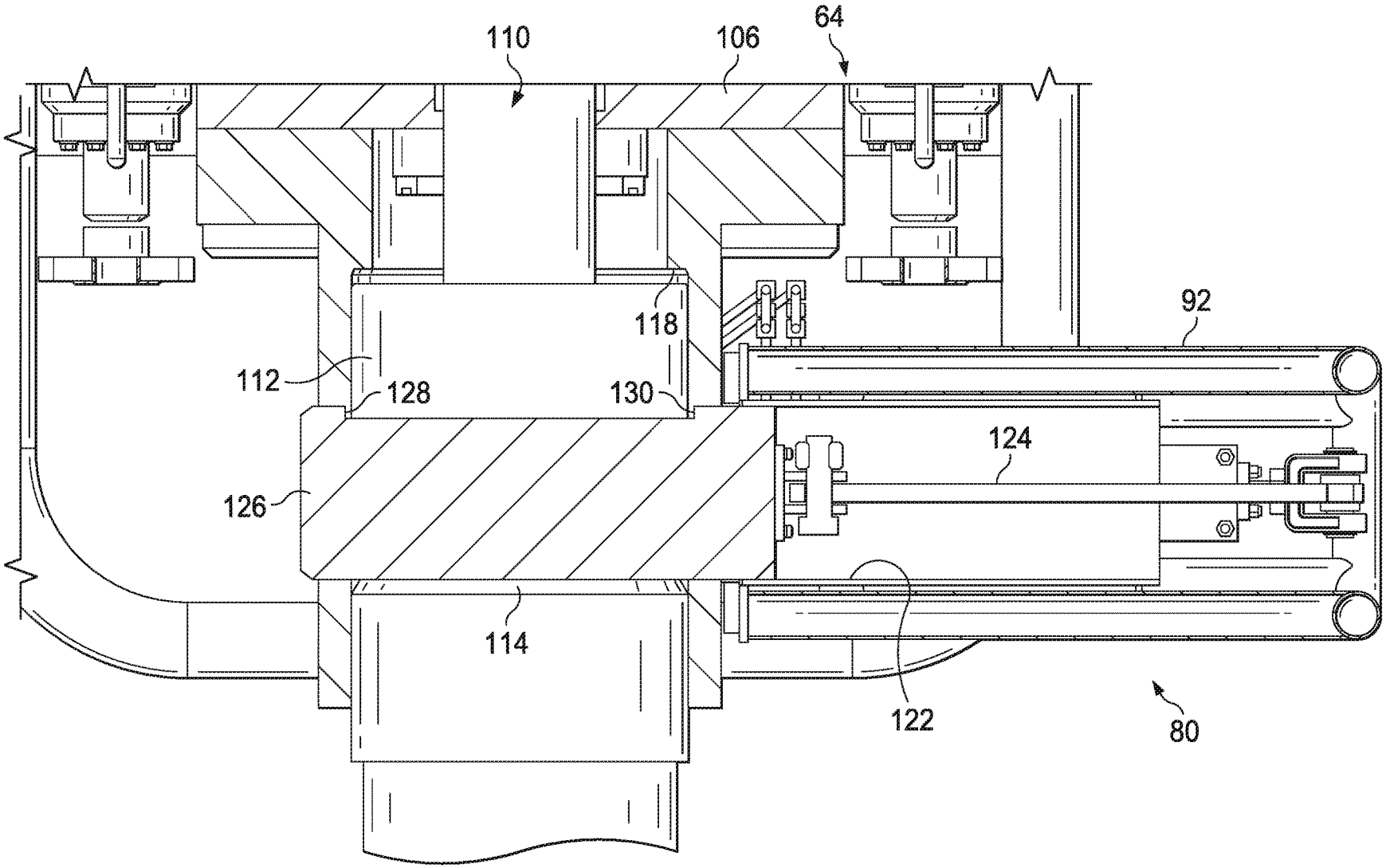
FIG. 4B depicts an enlarged cross-sectional view of a second end of the elongated vessel assembly and a lock assembly of the passive inline motion compensator, according to one or more illustrative embodiments.

In FIG. 4B an enlarged cross-sectional view of the second end 64 of the elongated vessel assembly 60 and the lock assembly 80 is presented. This view illustrates the locked configuration of the lock assembly 80. Persons of ordinary skill in the art will understand that the disclosure is not limited to a particular type of lock assembly. Lock assembly 80 may include pneumatic, hydraulic, electric or other types of mechanisms known in the art. Likewise, engagement mechanism 114 positioned adjacent rod 124 is not limited to a particular configuration. In certain embodiments, the lock assembly 80 may include an extendable appendage 126 that can be engaged and disengaged with rod 124 by activation of lock assembly 80, moveable between a first engaged position and a second retracted position. In certain embodiments, the lock assembly 80 is hydraulic and may include a hollow cylinder 122 in which appendage 126 is in the form of a pin coupled to a rod 124 that is slidingly disposed within cylinder 122. The appendage 126 may include a groove or recess 128 and a shoulder 130 for selectively engaging the distal end 110 of the elongated rod 98 via first aperture 114 of the rod head 112. When the appendage 126 is engaged with the first aperture 114, the inline motion compensator 14 is in a locked configuration. In one or more embodiments, appendage 126 is configured and selected to support the load from the static lift frame 22 and the well intervention equipment 28 when appendage 126 engages the first aperture 114.

To disengage the appendage 126 from first aperture 114, thereby unlocking the inline motion compensator 14, the compensation chamber 102 is charged with gas pressurized to at least the gas compensation pressure value as described with reference to FIG. 2. The introduction of the pressurized gas within the compensation chamber 102 exerts an axial force on the piston head 96 driving piston 94 towards the first end 62 of elongated vessel assembly 60. This disengages rod head 112 from recess 128 of appendage 126. It will be appreciated that in order to ensure full disengagement of the rod head 112 from recess 128, the rod 98 must move in an upward or first axial direction at least a distance equivalent to the height of shoulder 130. For this reason, when inline motion compensator 14 is in the locked position, piston 94 must be spaced apart from upper end 120 of vessel 66 at least height of the shoulder 130.

Once rod head 112 is disengaged from recess 128, appendage 126 may be retraced from first aperture 114. In one or more embodiments, the controller 24 may be used to convey hydraulic fluid through the hydraulic conduit 54 to the lock assembly 80 to retract the appendage 126. In other embodiments, pressurized gas may be used to retract the appendage 126. In any event, the rod 124 of the lock assembly 80 is actuated to withdraw appendage 126 from the first aperture 114, retracting the appendage 126 into the hollow cylinder 122. At this point, the inline motion compensator 14 is in an unlocked, compensation configuration.

Figure 4C:
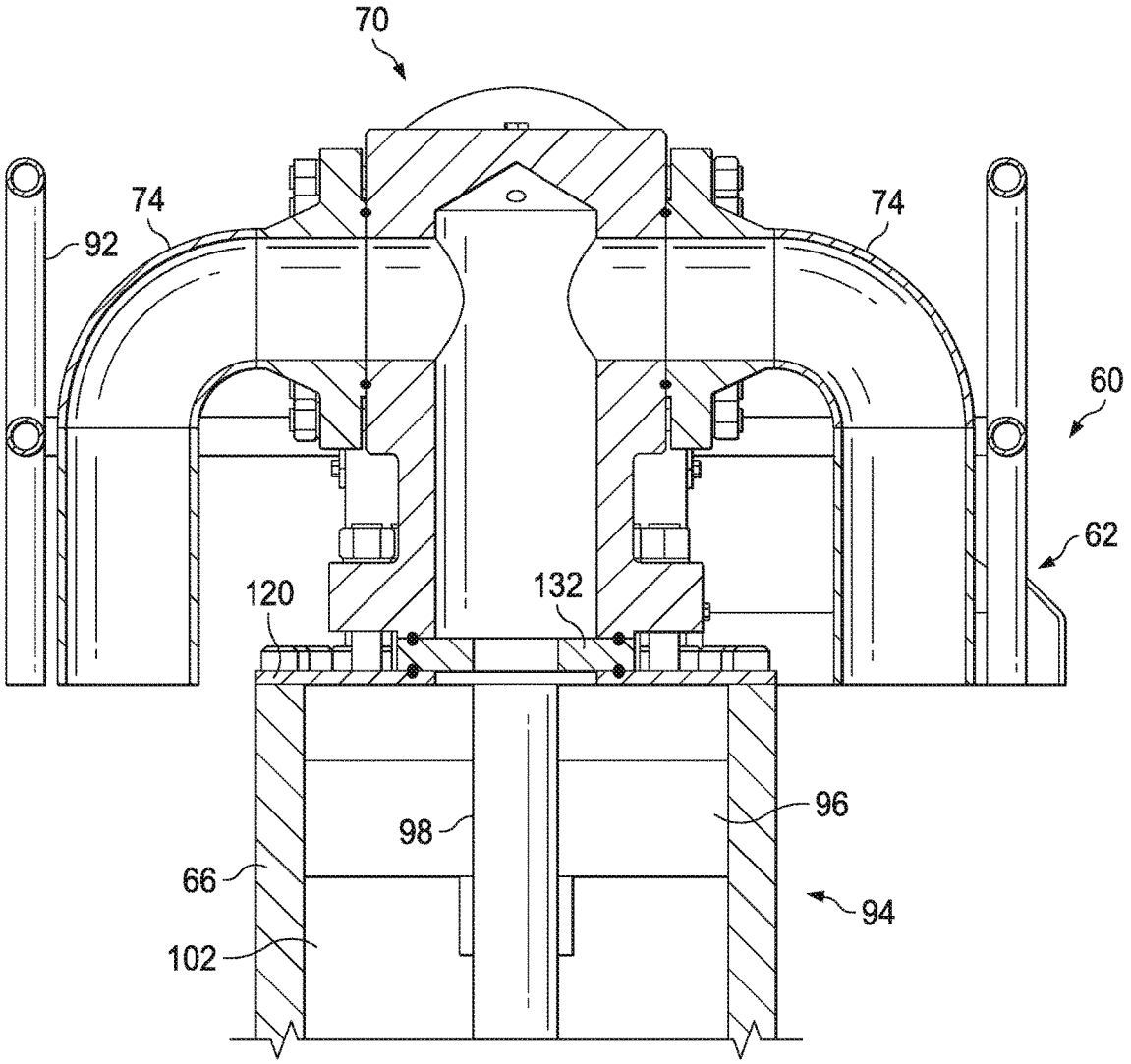
FIG. 4C depicts an enlarged cross-sectional view of a first end of the elongated vessel assembly, according to one or more illustrative embodiments.

Turning now to FIG. 4C, an enlarged cross-sectional view of the first end 62 of the elongated vessel assembly 60 is illustrated. This view illustrates the speed control valve 70 and blind chamber 100 after pressurized gas has been introduced to the compensation chamber 102 in order to unlock inline motion compensator 14. As previously mentioned, the speed control valve 70 operates to regulate the conveyance of liquid between the elongated vessel 66 and the reservoir assembly 72. In certain embodiments, the speed control valve 70 regulates the conveyance of liquid between the blind chamber 100 of the elongated vessel 66 and the first and/or second pressurized gas/liquid vessels 76, 78.

When inline motion compensator 14 is unlocked, the elongated rod 98 is free to reciprocate in and out of the elongated vessel 66 through the opening 104 at the second end 64 of the elongated vessel assembly 60 in response to the motion of the body of water 13. When piston head 96 of piston 94 is driven towards the second end 64 of elongated vessel assembly 60, as the blind chamber 100 is filled with liquid from the reservoir assembly 72, the elongated rod 98 axially advances through the opening 104. As the first pressurized gas/liquid vessel 76 and the second pressurized gas/liquid vessel 78 are under pressure, the liquid is urged to travel through the plurality of gas/liquid conduits 74 to the blind chamber 100, thereby advancing elongated rod 98 through the opening 104. Additionally, the reciprocation of the elongated rod 98 creates a vacuum within blind chamber 100 that draws the liquid from the pressurized gas/liquid vessel 76 and the second pressurized gas/liquid vessel 78 into blind chamber 100. Conversely, as the elongated rod 98 is urged through the opening 104 into the elongated vessel 66, the piston head 96 dispels liquid from the blind chamber 100 to the first pressurized gas/liquid vessel 76 and/or the second pressurized gas/liquid vessel 78. The speed control valve 70 regulates the velocity at which liquid may travel between the blind chamber 100 and the first pressurized gas/liquid vessel 76 and/or the second pressurized gas/liquid vessel 78. In particular, speed control valve 70 may include an orifice plate 132 to regulate the velocity of the fluid through speed control valve 70. In some embodiments, it may be desirable that standard operation dictate liquid flow rates of less than two feet per second through the speed control valve 70. During a certain events, such as high wave conditions or in cases where the well intervention equipment 28 becomes uncoupled from the subsea well 30, the orifice plate 132 restricts the maximum velocity of the liquid through the speed control valve 70, thereby dampening the velocity at which the elongated rod 98 is driven into elongated vessel 66. In some embodiments, this maximum velocity of the liquid may be limited to a predetermined value, such as for example, eleven feet per second. In this regard, orifice plate 132 may be adjusted or adjustable to control dampening under a particular set of conditions.

Figure 5:
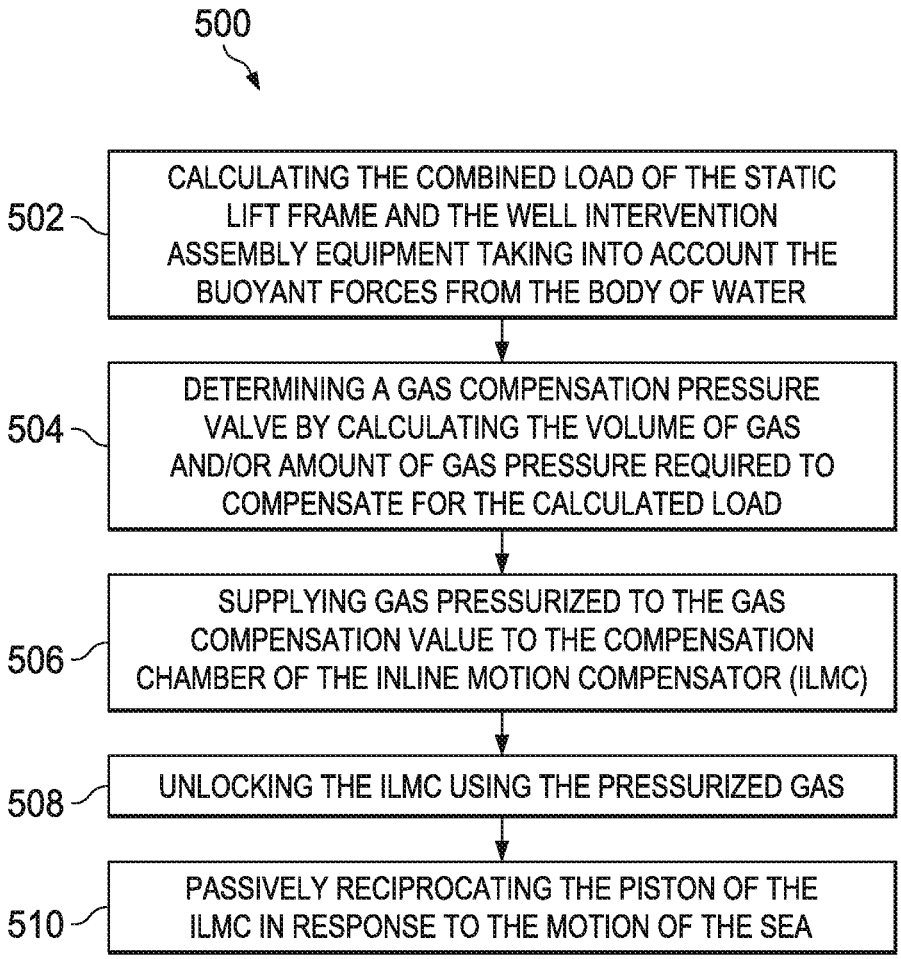
FIG. 5 is a flowchart illustrating an exemplary method for mitigating the relative movement between an offshore platform subject to the motion of a body of water and a well intervention assembly coupled to a subsea well that is affixed to a floor of the body of water.

With reference to FIG. 5, an exemplary method 500 for mitigating the relative movement between an offshore platform 12 and well intervention equipment 28 is presented.

Method 500 begins in step 502, where a gas compensation pressure value is determined for a static lift frame 22 and the well intervention equipment 28 suspended from an inline motion compensator 14. The gas compensation pressure value is determined initially by calculating the combined load of the static lift frame 22 and the well intervention equipment 28 taking into account buoyant forces from the body of water 13. In this regard, the combined weight of the static lift frame 22 and well intervention equipment 28 is determined and offset by buoyant forces acting on the well intervention equipment by virtue of the body of water 13.

In step 504, an additional calculation is then made to determine the volume of gas and/or gas pressure required to compensate for the combine calculated load given the volume of an elongated vessel 66 of static lift frame 22.

In step 506, gas pressurized to the gas compensation pressure value determined in steps 502 and 504 is supplied to the elongated vessel 66. In particular, the pressurized gas is supplied to the elongated vessel 66 in order to drive or actuate a piston 94 in a first direction. It will be appreciated from the description above that the piston 94 is attached to a lift sub assembly 90, which is utilized to engage the static lift frame 22 and well intervention equipment 28. A gas compression system 46 may be utilized to directly supply gas at the determined pressure. Alternatively, gas at the desired pressure may be stored in a gas pressure vessel assembly 18. In certain embodiments a controller 24 may be used to operate one or more components utilized to compress the gas to the desired gas compensation pressure value, which components may include a gas compression system 46, a gas compressor 48 and a pressure regulator 50. The pressure regulator 50 may be set to the gas compensation pressure value determined in steps 502 and 504. The gas compressor 48 is operable to send pressurized gas using a pneumatic conduit 52 through the pressure regulator 50 to the vessels 56 of the gas pressure vessel assembly 18.

In some embodiments, pressurized gas is also conveyed through the pressure regulator 50 to the controller 24 and subsequently routed to the charging manifold 20. In such an arrangement, the controller 24 can be utilized to operate the charging manifold 20 when the desired gas compensation pressure value is reached, thereby establishing fluid communication between the plurality of pneumatic conduits 52 and the inline motion compensator 14 and the gas pressure vessel assembly 18. At this point, the gas pressure vessel assembly 18, charging manifold 20 and the plurality of pneumatic conduits 52 are all pressurized to the gas compensation pressure value determined in steps 502 and 504. This pressurized gas is introduced to compensation chamber 102 of the inline motion compensator 14 through a compensation manifold assembly 82. In some embodiments, the compensation manifold assembly 82 includes a plurality of isolation valves 84, an inlet 86 and a stabilizer 88.

In any event, when gas pressurized to at least the gas compensation pressure value is introduced to the elongated vessel 66, and in particular, to the compensation chamber 102, the piston 94 is driven in the first axial direction, i.e., upward, such that the elongated rod 98 of the piston 94 is disengaged from the appendage 126 of the lock assembly 80 by lifting rod head 112 from recess 128 of the appendage 126.

In step 508, with the rod disengaged from the appendage 126, the appendage 126 can be withdrawn from aperture 114 of the rod head 112, thereby configuring inline motion compensator 14 to an unlocked state. In some embodiments, once the elongated rod 98 has been lifted so as to disengage rod head 112 from appendage recess 128, the controller 24 may be used to convey pressurized hydraulic fluid from a hydraulic power unit 58 through a hydraulic conduit 54 to the lock assembly 80. The hydraulic fluid is used to actuate a rod 124 that is coupled to the appendage 126 of the lock assembly 80. The rod 124 functions to withdraw the appendage 126 of the lock assembly 80 from the distal end 110 of the elongated rod 98 by removing the appendage 126 from the first aperture 114 in the rod head 112.

Finally in step 510, the inline motion compensator 14 is utilized to mitigate forces and stresses on the well intervention equipment 28 and hysteresis on offshore platform 12. In particular, gas having a predetermined pressure is maintained in vessel 66 in order to dampen the effects of the motion of the body of water 13 on these components. With the lock assembly 80 released and gas charged into chamber 102 of vessel 66, elongated rod 98 can passively reciprocate in and out of rod seal 108 of opening 104 with minimal loss of gas pressure. In some embodiments, the elongated rod 98 may passively reciprocate. As used herein, "passively" means the components of the inline motion compensator 14 operate without any electrical controls or instrumentation. As the elongated rod 98 reciprocates, pressurized liquid in the blind chamber 100 of the elongated vessel 66 is dispelled to and drawn from the reservoir assembly 72. The velocity of the pressurized liquid traveling between the blind chamber 100 and the reservoir assembly 72 is regulated by the speed control valve 70, which in some embodiments includes an orifice plate 132. The pressurized gas introduced within the compensation chamber 102 as discussed in step 506 provides a compensating force to counterbalance the vertical movement between the offshore platform 12 and the well intervention equipment 28 caused by the motion of the body of water 13. The gas pressure may be maintained at that pressure or reduced to a pressure below the gas compensation pressure value after removing the appendage 126 from the first aperture 114 in the rod head 112. In one or more embodiments, the pressure of the gas charged into vessel 66 may be adjusted in response to the condition of the motion of the body of water 13, such as the strength of currents or size of waves. For example, when body of water 13 is more turbulent it may be desirable to increase the pressure in more turbulent seas, while decreasing the pressure in calmer waters. Adjustments in gas pressure may be applied through the gas compression system 46 and the charging manifold 20. Moreover, such adjustments may be automated so that adjustments are made based on the condition of the waters. In this regard, controller 24 may be utilized for either manual or automated operation of gas compression system 46 and adjustments to the pressure of the gas utilized to implement the dampening as described herein. In this same vein, the gas pressure on one side of the piston (facing chamber 102) may be balanced or adjusted based on the liquid pressure applied to the opposite side of the piston (facing chamber 100). Regardless, it will be appreciated that such adjustments are much more readily and quickly implemented in the inline motion compensator 14 as described herein because of the use of pressurized gas in vessel 66, and in particular, on the rod side of piston 94, as opposed to hydraulic fluid utilized in prior art systems.

Thus a system for the passive inline motion compensator for use with offshore oil and gas production has been described. Embodiment of the system may include an elongated vessel assembly having a first end, a second end and an elongated vessel; a piston having a piston head with an elongated rod extending from the piston head, the piston slidingly disposed within the elongated vessel so as to define a blind chamber within the vessel between the piston and the first end of the vessel and a compensation chamber within the vessel between the piston and the second end of the vessel; a liquid reservoir assembly in fluid communication with the blind chamber of the elongated vessel; and a compressed gas source in fluid communication with the compensation chamber.

For the foregoing embodiment, the system for the passive inline motion compensator for use with offshore oil and gas production may further include any one of the following elements, alone or in combination with each other:

An opening in the second end of the chamber through which the rod extends; and a polytetrafluoroethylene seal disposed in the opening, the polytetrafluoroethylene seal sealingly engaging the rod.

An opening in the second end of the chamber through which the rod extends; and a thermoplastic polymer seal disposed in the opening, the thermoplastic polymer seal sealingly engaging the rod.

The elongated rod further comprising a first aperture at a distal end of the elongated rod; and the compensator further comprises a lock assembly having a reciprocal pin positioned adjacent the aperture and extendable into the aperture, the pin having a recess in which the rod can seat when the pin is within the aperture.

A speed control valve in fluid communication with the blind chamber and the liquid reservoir assembly.

The speed control valve further comprising an orifice plate.

A static lift frame coupled to the distal end of the elongated rod.

The static lift frame further comprising a bail assembly.

A controller in hydraulic communication with the lock assembly of the inline motion compensator and in pneumatic communication with the compressed gas source.

Additionally an alternate embodiment of a passive inline motion compensator for use with offshore oil and gas production has been described herein. Such an embodiment may include an elongated vessel assembly having a first end, a second end and an elongated vessel; a piston having a piston head with an elongated rod extending from the piston head, the piston slidingly disposed within the elongated vessel so as to define a blind chamber within the vessel between the piston and the first end of the vessel and a compensation chamber within the vessel between the piston and the second end of the vessel; an opening in the second end of the chamber through which the rod extends; and a thermoplastic polymer seal disposed in the opening, the thermoplastic polymer seal sealingly engaging the rod; a lock assembly disposed adjacent a distal end of the of the elongated rod, the lock assembly movable between a first position in which the lock assembly engages said rod and a second position in which lock assembly is disengaged from said rod; a liquid reservoir assembly in fluid communication with the blind chamber of the elongated vessel; and a compressed gas source in fluid communication with the compensation chamber.

Further an additional alternate embodiment of a passive inline motion compensator for use with offshore oil and gas production has been described herein. Such an embodiment may include an elongated vessel assembly having a first end, a second end and an elongated vessel, the elongated vessel having a piston with a head and an elongated rod, the piston defining a blind chamber and a compensation chamber within the elongated vessel; a lock assembly selectively engaged to a distal end of the elongated rod; and a reservoir assembly in fluid communication with the blind chamber of the elongated vessel; wherein the compensation chamber of the elongated vessel is filled with pressurized gas to compensate for movement between the offshore platform and the well intervention assembly coupled to the subsea well.

For the foregoing embodiment, the system for the passive inline motion compensator for use with offshore oil and gas production may further include any one of the following elements, alone or in combination with each other:

A lift sub assembly connected to the distal end of the elongated rod.

An opening to allow reciprocation of the elongated rod in and out of the elongated vessel, the opening having a rod seal.

The elongated rod being disposed in the compensation chamber of the elongated vessel.

The elongated rod comprising a first aperture and a second aperture oriented on transverse axes located at the distal end of the elongated rod.

The lock assembly comprising a pin containing a shoulder and groove to selectively engage the first aperture of the elongated rod.

The reservoir assembly comprising a first pressurized gas/liquid vessel and a second pressurized gas/liquid vessel.

A speed control valve in fluid communication with the blind chamber of the elongated vessel and the reservoir assembly.

The speed control valve further comprising an orifice plate.

A compensation manifold assembly in fluid communication with the compensation chamber of the elongated vessel.

Additionally a passive inline motion compensator system for use with offshore oil and gas production has been described herein. Embodiment of the system may include an inline motion compensator having an elongated vessel assembly having a first end, a second end and an elongated vessel; a piston having a piston head with an elongated rod extending from the piston head, the piston slidingly disposed within the elongated vessel so as to define a blind chamber within the vessel between the piston and the first end of the vessel and a compensation chamber within the vessel between the piston and the second end of the vessel; an opening in the second end of the chamber through which the rod extends; and a thermoplastic polymer seal disposed in the opening, the thermoplastic polymer seal sealingly engaging the rod; a liquid reservoir assembly in fluid communication with the blind chamber of the elongated vessel; and a compressed gas source in fluid communication with the compensation chamber; a lock assembly disposed adjacent a distal end of the of the elongated rod, the lock assembly movable between a first position in which the lock assembly engages said rod and a second position in which lock assembly is disengaged from said rod; a static lift frame coupled to the elongated rod of the inline motion compensator; and a controller in fluid communication the inline motion compensator and the lock assembly.

For the foregoing embodiment, the system for the passive inline motion compensator for use with offshore oil and gas production may further include any one of the following elements, alone or in combination with each other:

The elongated rod being disposed in the compensation chamber of the elongated vessel.

The elongated rod further comprising a first aperture and a second aperture oriented on transverse axes located at the distal end of the elongated rod.

The reservoir assembly comprising a first pressurized gas/liquid vessel and a second pressurized gas/liquid vessel.

A compensation manifold assembly in fluid communication with the compensation chamber of the elongated vessel.

Additionally a passive compensation system for dampening relative motion caused by a fluctuating sea between an offshore platform and a well intervention assembly that is coupled to a subsea well has been described herein. Embodiment of the system may include a passive inline motion compensator comprising an elongated vessel assembly having a first end, a second end and an elongated vessel, the elongated vessel having a piston with a head and an elongated rod, the piston defining a blind chamber and a compensation chamber of the elongated vessel; a lock assembly selectively engaged to a distal end of the elongated rod; and a reservoir assembly in fluid communication with the blind chamber of the elongated vessel; wherein the compensation chamber of the elongated vessel is filled with pressurized gas to compensate for movement between the offshore platform and the well intervention assembly fixed to a sea floor; a top drive assembly; a gas pressure vessel assembly comprising a plurality of vessels containing pressurized gas in fluid communication with compensation chamber of the elongated vessel; a charging manifold in fluid communication with and operable to increase the pressure of the pressurized gas in the compensation chamber of the elongated vessel; a static lift frame coupled to a lift sub assembly and the inline motion compensator; and a controller in fluid communication with the lock assembly, the gas pressure vessel assembly and the charging manifold.

For the foregoing embodiment, the passive compensation system for dampening relative motion caused by a fluctuating sea between an offshore platform and a well intervention assembly that is coupled to a subsea well may further include any one of the following elements, alone or in combination with each other:

The first end of the elongated vessel assembly comprising a bail assembly for engaging the top drive assembly.

The charging manifold in fluid communication with a compensation manifold assembly of the inline motion compensator and the gas pressure vessel assembly.

The static lift frame comprising a bail assembly.

The controller in hydraulic fluid communication with the lock assembly.

The controller is in pneumatic fluid communication with the gas pressure vessel assembly and the charging manifold.

The compensation chamber of the elongated vessel comprising an opening to allow reciprocation of the elongated rod in and out of the elongated vessel, the opening having a rod seal.

The elongated rod being disposed in the compensation chamber of the elongated vessel.

The elongated rod comprising a first aperture and a second aperture oriented on transverse axes located at the distal end of the elongated rod.

The lock assembly comprising a pin containing a shoulder and groove to selectively engage the first aperture of the elongated rod.

The reservoir assembly comprising a first pressurized gas/liquid vessel and a second pressurized gas/liquid vessel.

A speed control valve in fluid communication with the blind chamber of the elongated vessel and the reservoir assembly.

The speed control valve comprising an orifice plate.

The compensation manifold assembly being in fluid communication with the compensation chamber of the elongated vessel.

Thus a method for mitigating the relative movement between an offshore platform and well intervention equipment in hydrocarbon recovery operations has been described herein, wherein the method includes determining a gas compensation pressure value based on at least a static lift frame and well intervention equipment supported by the static lift frame; charging a vessel with gas pressurized at least to the gas compensation pressure value and utilizing the pressurized gas to actuate a piston, thereby lifting the static lift frame; activating a lock assembly in order to release a rod supporting the static lift frame and well intervention equipment once the vessel has been charged with gas pressurized to at least the gas compensation pressure value; and maintaining a gas pressure on the piston in order to at least partially support the static lift frame and well intervention equipment.

For the foregoing embodiment, the method may include any of the following steps alone or in combination with each other:

Adjusting the pressure of the gas within the vessel based on condition of the body of water supporting the offshore platform.

Counteracting movement of the piston in the vessel with liquid charged into the vessel.

Counteracting movement of the piston in the vessel with liquid charged into the vessel by adjusting the flow rate of the liquid out of the vessel.

Hydraulically activating the lock assembly and pneumatically activating the piston.

Additionally method of mitigating relative movement between an offshore platform subject to the motion of a sea and a well intervention assembly coupled to a subsea well affixed to a sea floor has been described herein, wherein the method includes attaching a passive inline motion compensator in a locked state to a top drive assembly of a derrick, the inline motion compensator having an first end, a second end and an elongated vessel, the elongated vessel having a piston with a head and an elongated rod, the piston defining a blind chamber and a compensation chamber of the elongated vessel; a lock assembly selectively engaged to a distal end of the elongated rod; a lift sub assembly connected to the distal end of the elongated rod; and a reservoir assembly in fluid communication with the blind chamber of the elongated vessel; attaching a static lift frame to the lift sub assembly and coupling a well intervention assembly that is connected to a subsea well to the static lift frame; determining a gas compensation pressure value corresponding to a combined load of the static lift frame and well intervention assembly; pressurizing the passive inline motion compensator with gas to the gas compensation pressure value corresponding to the combined load of the static lift frame and the well intervention assembly; unlocking the passive inline motion compensator from the locked state; and passively reciprocating the piston of the inline motion compensator in response to the motion of the sea.

For the foregoing embodiment, the method may include any of the following steps alone or in combination with each other:

Substantially retracting the piston head and elongated rod within the elongated vessel.

Filling the compensation chamber of the elongated vessel with pressurized gas through a compensation manifold assembly.

Increasing the gas pressure to the passive inline motion compensator above the gas compensation pressure value using the charging manifold.

Unlocking the passive inline motion compensator from the locked state by completely retracting the piston head within the elongated vessel.

Unlocking the passive inline motion compensator from the locked state by disengaging a pin of the lock assembly with the distal end of the elongated rod.

Passively reciprocating the piston of the passive inline motion compensator in response to the motion of the sea by raising the top drive assembly and extending the elongated rod out of the elongated vessel.

Passively reciprocating the piston of the passive inline motion compensator in response the motion of the sea further by reciprocating liquid from the blind chamber of the elongated vessel to the reservoir assembly.

Reciprocating liquid from the blind chamber of the elongated vessel to the reservoir assembly further by conveying the liquid through a speed control valve in fluid communication with the blind chamber of the elongated vessel and the reservoir assembly.

The above specific example embodiments are not intended to limit the scope of the claims. The example embodiments may be modified by including, excluding, or combining one or more features or functions described in the disclosure.

What is claimed is:

1. A passive inline motion compensator for use with offshore oil and gas production, the inline motion compensator comprising:

an elongated vessel assembly having a first end, a second end and an elongated vessel coupled between the first end and second end;

a piston having a piston head with an elongated rod extending from the piston head, the elongated rod having a rod head and the piston head slidingly disposed within the elongated vessel so as to define a blind chamber within the vessel between the piston head and the first end of the elongated vessel assembly and a compensation chamber within the vessel between the piston head and the second end of the elongated vessel assembly;

a liquid reservoir assembly in fluid communication with the blind chamber of the elongated vessel;

a compressed gas source in fluid communication with the compensation chamber such that the compensation chamber is filled with pressurized gas, wherein the elongated rod extends through the compensation chamber and an opening defined in the second end of the elongated vessel assembly;

a bail assembly operably coupled to the elongated vessel assembly; and a lock assembly disposed adjacent the elongated rod, the lock assembly selectively movable between a first position in which the lock assembly engages the rod head of the elongated rod thereby inhibiting movement of the elongated rod with respect to the elongated vessel and a second position in which the lock assembly is disengaged from the rod head of the elongated rod thereby permitting movement of the elongated rod with respect to the elongated vessel assembly.

2. The compensator of claim 1, further comprising a polytetrafluoroethylene seal disposed in the opening, the polytetrafluoroethylene seal sealingly engaging the rod.

3. The compensator of claim 1, further comprising a thermoplastic polymer seal disposed in the opening, the thermoplastic polymer seal sealingly engaging the rod.

4. The compensator of claim 1, wherein the elongated rod further comprises a first aperture axially aligned with the elongated rod at a distal end of the elongated rod; and wherein the lock assembly includes a reciprocal pin positioned adjacent the aperture and extendable into the aperture, the pin having a recess in which the rod can seat when the pin is within the aperture.

5. The passive inline motion compensator of claim 1, further comprising a speed control valve in fluid communication with the blind chamber and the liquid reservoir assembly.

6. The passive inline motion compensator of claim 5, wherein the speed control valve further comprises an orifice plate.

7. The passive inline motion compensator of claim 1, further comprising a static lift frame coupled to the distal end of the elongated rod.

8. The passive inline motion compensator of claim 7, wherein the static lift frame further comprises a protective bumper frame positioned around the elongated vessel.

9. The passive inline motion compensator of claim 4, further comprising a controller in hydraulic communication with the lock assembly of the inline motion compensator and in pneumatic communication with the compressed gas source, and wherein the piston head is substantially retracted within the elongated vessel when the lock assembly engages the rod head of the elongated rod.

10. The compensator of claim 4, wherein the reciprocal pin includes a shoulder defined thereon for selectively engaging the elongated rod to prevent withdrawal of the reciprocal pin from the aperture.

11. A passive inline motion compensator for use with offshore oil and gas production, the inline motion compensator comprising:

an elongated vessel assembly having a first end, a second end and an elongated vessel;

a bail assembly operably coupled to the elongated vessel assembly;

a piston having a piston head with an elongated rod extending from the piston head, the elongated rod having a rod head and the piston head slidingly disposed within the elongated vessel so as to define a blind chamber within the vessel between the piston head and the first end of the elongated vessel assembly and a compensation chamber within the vessel between the piston head and the second end of the elongated vessel assembly, wherein the rod extends through the compensation chamber;

an opening in the second end of the elongated vessel assembly, a distal end of the rod extending the opening; and a thermoplastic polymer seal disposed in the opening, the thermoplastic polymer seal sealingly engaging the rod;

a lock assembly disposed adjacent the distal end of the of the elongated rod, the lock assembly movable between a first position in which the lock assembly engages said rod head to thereby inhibit movement of the elongated rod with respect to the elongated vessel and a second position in which lock assembly is disengaged from said rod head thereby permitting movement of the elongated rod with respect to the elongated vessel;

a liquid reservoir assembly in fluid communication with the blind chamber of the elongated vessel; and a compressed gas source in fluid communication with the compensation chamber through which the rod extends.

12. A passive inline motion compensator system for use with offshore oil and gas production, the inline motion compensator comprising:

an inline motion compensator having an elongated vessel assembly having a first end, a second end and an elongated vessel; a piston having a piston head with an elongated rod extending from the piston head, the elongated rod defining a rod head, and the piston slidingly disposed within the elongated vessel so as to define a blind chamber within the vessel between the piston head and the first end of the elongated vessel assembly and a compensation chamber within the vessel between the piston head and the second end of the elongated vessel assembly; an opening in the second end of the elongated vessel assembly, the rod extending through the compensation chamber and the opening;

and a thermoplastic polymer seal disposed in the opening, the thermoplastic polymer seal sealingly engaging the rod; a liquid reservoir assembly in fluid communication with the blind chamber of the elongated vessel; and a compressed gas source in fluid communication with the compensation chamber through which the rod extends;

a lock assembly disposed adjacent a distal end of the of the elongated rod, the lock assembly movable between a first position in which the lock assembly engages said rod head to thereby inhibit movement of the elongated rod with respect to the elongated vessel and a second position in which lock assembly is disengaged from said rod head thereby permitting movement of the elongated rod with respect to the elongated vessel;

a static lift frame coupled to the elongated rod of the inline motion compensator;

a bail assembly operably coupled to the elongated vessel assembly, the bail assembly for engaging a top drive assembly; and a controller in fluid communication the inline motion compensator and the lock assembly.

13. The passive inline motion compensator system of claim 12, wherein the elongated rod further comprises a first aperture and a second aperture located at the distal end of the elongated rod, the second aperture oriented transversely with respect to the first aperture.

14. The passive inline motion compensator system of claim 12, wherein the reservoir assembly comprises a first pressurized gas/liquid vessel and a second pressurized gas/liquid vessel.

15. The passive inline motion compensator of claim 12, further comprising a compensation manifold assembly in fluid communication with the compensation chamber of the elongated vessel.

16. A method for mitigating the relative movement between an offshore platform and well intervention equipment in hydrocarbon recovery operations, the method comprising:

determining a gas compensation pressure value based on at least a static lift frame and well intervention equipment supported by the static lift frame;

charging a compensation chamber within an elongated vessel with gas pressurized at least to the gas compensation pressure value and utilizing the pressurized gas to actuate a piston head, thereby lifting the static lift frame;

activating a lock assembly in order to disengage the lock assembly from a rod head of a rod extending through the compensation chamber and coupled to the piston head, the rod supporting the static lift frame and well intervention equipment once the compensation chamber has been charged with gas pressurized to at least the gas compensation pressure value wherein disengaging the rod head moves the elongated rod from a non-compensation configuration wherein movement of the elongated rod with respect to the compensation chamber is inhibited by engagement of the lock assembly with the rod head and a compensation configuration wherein movement of the elongated rod with respect to the compensation chamber is permitted;

maintaining a gas pressure on the piston head in order to at least partially support the static lift frame and well intervention equipment; and engaging a bail assembly of the static lift frame to a top drive assembly; and operating the top drive assembly to adjust a height of the elongated vessel with respect to the offshore platform.

17. The method of claim 16, further comprising, once the rod has been released, adjusting the pressure of the gas within the vessel based on condition of a body of water supporting the offshore platform.

18. The method of claim 16, further comprising counteracting movement of the piston head in the vessel with liquid charged into a blind chamber defined in the vessel.

19. The method of claim 18, wherein counteracting comprises adjusting a flow rate of the liquid out of the vessel.

20. The method of claim 16, further comprising hydraulically activating the lock assembly and pneumatically activating the piston head.

* * * * *